United States Patent [19]

Keller

[11] Patent Number: 4,494,034

[45] Date of Patent: Jan. 15, 1985

[54] MAGNETRON FILAMENT HAVING A QUADRILATERAL CROSS-SECTION

[75] Inventor: Robert F. Keller, Lancaster, Pa.

[73] Assignee: RCA Corporation, New York, N.Y.

[21] Appl. No.: 448,402

[22] Filed: Dec. 9, 1982

[51] Int. Cl.[3] ..... H01J 1/15; H01J 19/08; H01K 1/02

[52] U.S. Cl. ..... 313/341; 315/39.51; 315/337

[58] Field of Search ..... 315/39.51; 313/341, 313/344, 337

[56] References Cited

U.S. PATENT DOCUMENTS

| | | | |
|---|---|---|---|
| 2,526,054 | 10/1950 | Warren | 250/27.5 |
| 2,998,544 | 8/1961 | Crapuchettes | 315/39.51 |
| 3,514,661 | 5/1970 | Reaves | 313/346 |
| 3,566,179 | 2/1971 | Kumpfer | 313/341 |
| 3,914,639 | 10/1975 | Barraco et al. | 313/341 |
| 4,229,676 | 10/1980 | Manoly | 315/3.5 |
| 4,230,968 | 10/1980 | Oguro | 313/341 |
| 4,264,843 | 4/1981 | Hammersand | 315/39.51 |

OTHER PUBLICATIONS

RCA 8684–Large Power Magnetron Tube Bulletin, published Aug. 1975.

Mechanical Springs, Their Engineering and Design, pp. 23 & 27, published by the William D. Gibson Co.

*Primary Examiner*—Saxfield Chatmon

*Attorney, Agent, or Firm*—Eugene M. Whitacre; Dennis H. Irlbeck; Vincent J. Coughlin, Jr.

[57] ABSTRACT

A magnetron includes an evacuated envelope having therein a cathode assembly. An anode electrode surrounds the cathode assembly. The cathode assembly is formed of a helically wound filament having a quadrilateral cross-section. One of the surfaces of the quadrilateral cross-section filament is wider than the others. The wider surface of the filament faces the anode electrode. The quadrilateral cross-section thereby increasing the sag resistance of the filament.

5 Claims, 6 Drawing Figures

MAGNETRON FILAMENT HAVING A QUADRILATERAL CROSS-SECTION

BACKGROUND OF THE INVENTION

This invention relates to a magnetron, and more particularly to a low angle helically wound magnetron filament having a quadrilateral cross section which provides increased sag resistance at high operating temperatures.

Magnetrons are used as ultra-high frequency oscillators for use in microwave ovens or the like. Usually, in the case of industrial microwave ovens, the magnetron is capable of generating useful continuous radio frequency (rf) power in the range of 10 to 50 kilowatts (kw) at very high efficiency. A conventional magnetron, such as the RCA 8684 Large Power Magnetron, is useful as a 915-Mhz, 30 kw rf power source in industrial processing applications. In the operation of such a magnetron, the cathode filament operates at about 2000° C. to provide 3 amperes of anode current. In order to achieve a power output of 50 kilowatts, it is necessary to operate a cathode filament at 2150° C. to obtain 4 amperes of anode current. At such an elevated cathode filament temperature, the conventional helically wound circular cross-section filament tends to sag. Since a circular cross-section filament emits electrons over an arc of about 120° , some of the electrons from the extremeties of the arc are turned by the magnetic field and return to the filament producing "back heating" which further increases the cathode filament temperature. In the aforementioned magnetron, the coil length of the wound filament is about 48.26 mm. The weight of the lengthy filament in conjunction with the high operating temperature further increases the tendency of the filament to sag. As the helically wound circular cross-section filament sags, it also rotates because of torque. These factors frequently result in a decrease in tube efficiency and premature tube failure. It is, therefore, desirable to provide a filament that can operate at a temperature of at least 2150° C. without sagging.

SUMMARY OF THE INVENTION

A magnetron includes an evacuated envelope having therein a cathode assembly. An anode electrode surrounds the cathode assembly. The cathode assembly is formed of a helically wound filament having a quadrilateral cross-section. One of the surfaces of the quadrilateral cross-section filament is wider than the others. The wider surface of the filament faces the anode electrode. The quadrilateral cross-section increases the sag resistance of the filament.

DETAILED DESCRIPTION OF THE PREFERRED EMBODIMENT

Figure 1:
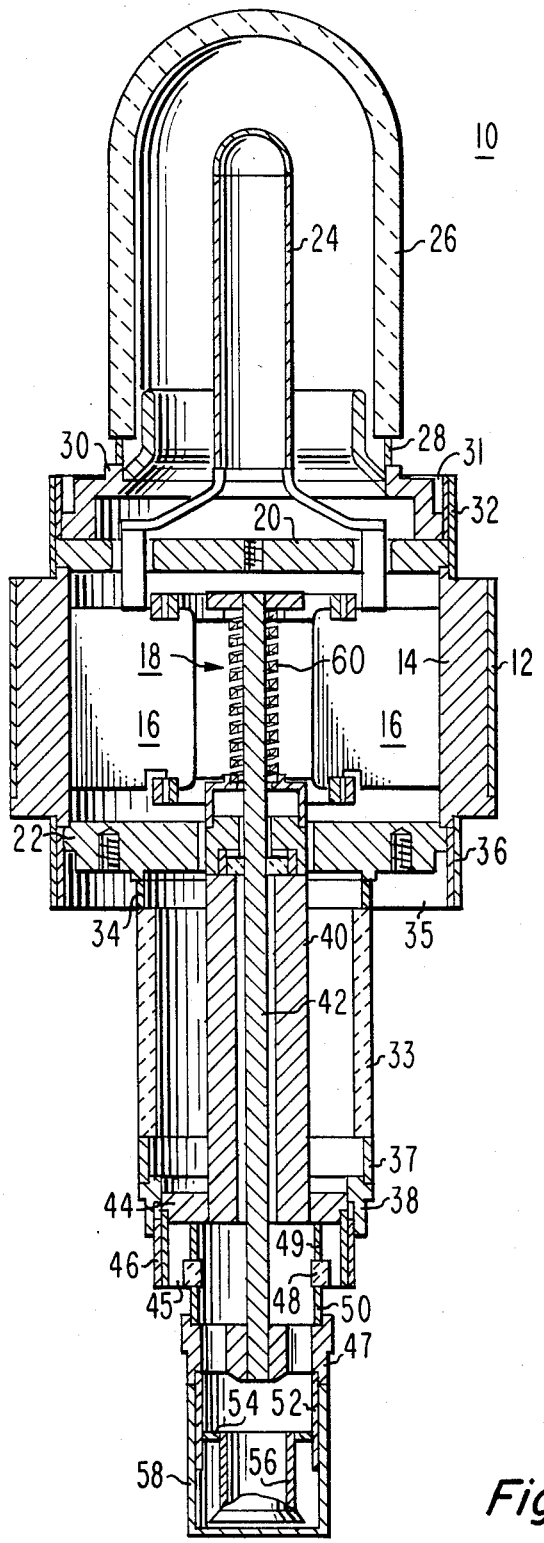
FIG. 1 is a cross-sectional view of a large power magnetron having a cathode assembly in accordance with the present invention.

A large power magnetron 10 is shown in FIG. 1. The magnetron 10 includes an evacuated envelope 12 of ceramic-metal construction. An anode cylinder 14 forms a portion of the envelope 12. The anode cylinder 14 is provided with a plurality of radial anode vanes 16 secured to the inner surface of the anode cylinder. Centrally disposed within the anode cylinder 14 is a high temperature cathode assembly 18. A pair of magnetic pole pieces 20 and 22 are disposed on opposing ends of the anode cylinder 14 and attached thereto. An antenna 24 is connected at one end to the radial anode vanes 16 and extends through the magnetic pole piece 20. The antenna 24 is enclosed within an output dome 26, preferably formed of a high aluminum ceramic material. The output dome 26 is fixedly attached, for example, by brazing to an output support flange 28 which, in turn, is brazed to an output support ring 30. The output support ring 30 is brazed to a weld flange 31. An upper anode flange 32 is brazed to the anode cylinder 14 and heliarc welded to the weld flange 31 to close the upper portion of the envelope 12. The other end of the envelope 12 comprises a hollow cylindrical cathode insulating member 33, preferably a high alumina ceramic, which is attached at one end to a pole piece flange 34. The pole piece flange 34 is fixedly attached, for example, by brazing to the pole piece 22. A pole piece weld flange 35 is brazed to the outer periphery of the pole piece 22. A lower anode flange 36 is brazed to the anode cylinder 14 and heliarc welded to the weld flange 36 to attach the pole piece 22 to the anode cylinder 14. The other end of the cathode insulating member 33 is brazed to a cathode support flange 37 which, in turn, is brazed to a filament-cathode terminal contact 38. The cathode assembly 18 includes an outer conductor 40 and an inner conductor 42, disposed coaxially within, and insulated from, the outer conductor 40. The conductors 40 and 42 extend through the center of the magnetic pole piece 22 and within the cathode insulating member 33. The outer conductor 40 is attached to a transition plate 44. A transition plate flange 45 is brazed to the outer periphery of the transition plate 44. A filament cathode terminal flange 46 is brazed to the terminal contact 38 and heliarc welded to the transition plate flange 45. The inner conductor 42 terminates in a filament terminal contact 47 which is insulatingly attached at one end to the transition plate 44 by means of an isolation insulator 48, preferably formed of high alumina ceramic material. One end of the isolation insulator 48 is brazed to an output conductor collar 49. The collar 49, in turn, is brazed to the transition plate 44. The other end of the isolation insulator 48 is brazed to a filament terminal collar 50 which is attached to the filament terminal contact 47. The other end of the filament terminal contact 47 includes an exhaust sleeve 52 having an exhaust flange 54 attached thereto. A copper exhaust tubulation 56 (shown as being crimped shut) is brazed to the exhaust flange 54. A protective cap 58 is disposed over the exhaust tubulation 56.

Figure 2:
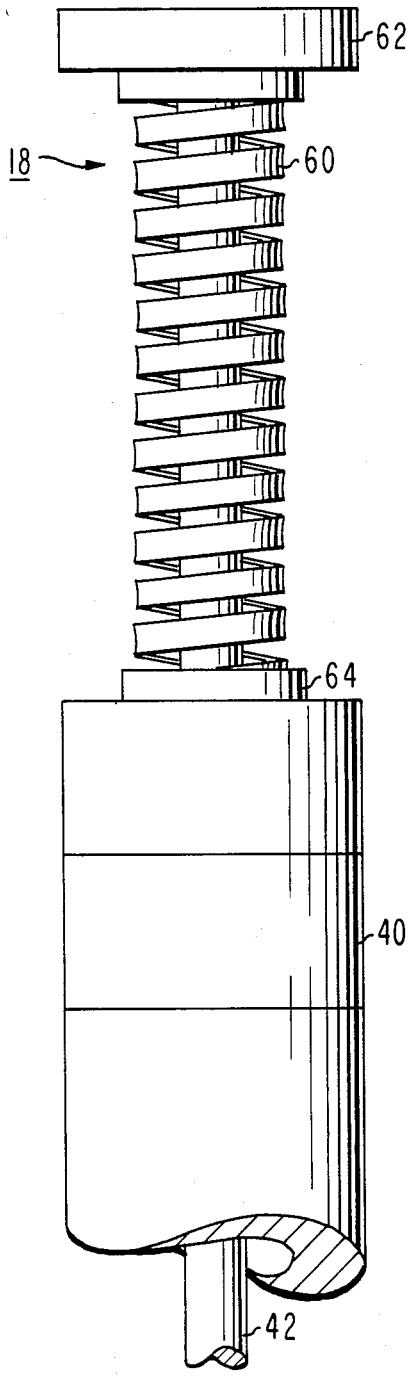
FIG. 2 is a plan view of a portion of the cathode assembly of the present invention.
Figure 3:
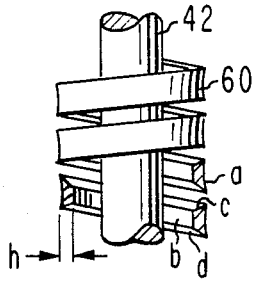
FIG. 3 is a fragmentary view of a portion of the quadrilateral cross-section filament of the cathode assembly of the present invention.

In accordance with the present invention, the cathode assembly 18 comprises a low angle helically wound filament 60 which acts as the cathode electrode of the magnetron 10. The filament 60 is preferably made of non-sag doped tungsten wire having a double retreat and ordered grain structure. The tungsten wire which is purchased having a circular cross-section is formed, as described hereinafter, to have a quadrilateral, or more specifically a trapezoidal, cross-section. The trapezoidal cross-section filament wire is helically wound at a low angle to approximate a substantially smooth cylindrical surface. In order to maximize the electron emission surface of the filament 60, the trapezoidal cross-section filament wire is wound as shown in FIGS. 2 and 3. The tungsten wire is wound so that the widest surface of the trapezoid forms the exterior surface, a, of the filament 60. The interior surface of the filament 60 is designated as surface b, and the two sides are designated as surfaces c and d, respectively. The height, i.e., the distance between exterior surface a and interior surface b, is designated as h. The opposite ends of the filament 60 are attached, for example, by welding to a pair of disc-shaped end shields 62 and 64. One end shield 62 is connected to the inner conductor 42 which extends through an opening in the other end shield 64 which is attached to the outer conductor 40. By winding the trapezoidal cross-section filament wire as shown in FIGS. 2 and 3, the exterior surface, a, is held in tension and the interior surface, b, is placed in compression. The tension on exterior surface, a, of filament 60 results in a slightly concave surface shape which focuses the emitted electrons and further reduces back heating of the filament 60 from edge emitted electrons which, in conventional circular cross-section filaments, spiral back to the filament due to the effect of the magnetic field.

As an explicit example, and without limiting the invention in any way, the following specific dimensions shown in the figures were utilized to construct a filament 60 for use in an RCA C94600E, 50 kilowatt large power magnetron.

| | | |
|---|---|---|
| surface, a, | 2.54 mm | 0.1 in. |
| surface, b, | 1.42 mm | 0.056 in. |
| height, h, | 1.52 mm | 0.06 in. |
| cross-sectional area of | 3.02 $mm^2$ | $4.68 \times 10^{-3}$ $in.^2$ |
| coil length | 48.26 mm | 1.9 in. |
| spacing between adjacent coils | 0.81 mm | 0.033 in. |
| outside diameter | 12.45 mm | 0.49 in. |
| inside diameter | 9.40 mm | 0.37 in. |
| turns per 25.4 mm | 7.5 | |

Figure 4:
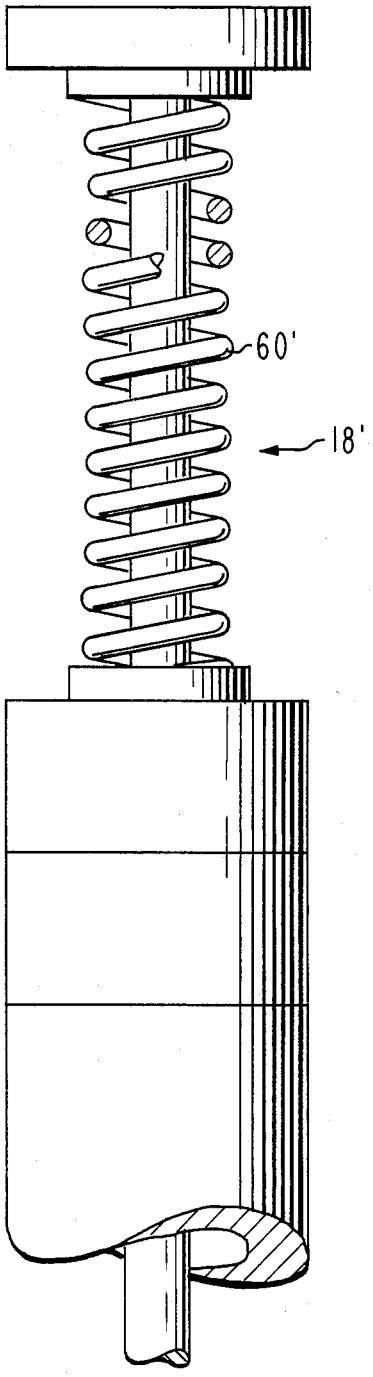
Fig. 4 PRIOR ART
FIG. 4 is an enlarged partially cut-away view of a prior art cathode assembly.

For comparison purposes, a prior art cathode assembly 18' having a circular cross-section filament 60' is shown in FIG. 4. The filament 60' is formed of tungsten wire having a diameter of 1.98 mm (0.078 in.) with a resultant cross-sectional area of approximately 3.08 $mm^2$. The filament 60' has a coil length and number of coils identical to the above-described novel filament 60. Thus, the spacing between adjacent coils for filament 60' is 1.40 mm. It is apparent that the novel trapezoidal cross-section filament 60 wound with the widest surface as the exterior surface, a, provides a greater emission surface than a convention circular cross-section filament having a substantially equal cross-sectional area. Furthermore, since electrons leave the surface of the filament with an initial direction substantially normal to the surface, significantly fewer electrons spiral back to the filament 60 from the emission surface, a, than from the prior art filament 60' where electrons are emitted over an arcuate surface of about 120° . Thus, less electron induced back heating occurs in the novel filament 60.

The trapezoidal cross-section filament 60 is intrinsically stronger and more sag resistant, i.e., it has greater torsional stress, than the circular cross-section filament 60'. The stress formula for a round wire is given by the formula $$S = \frac{8PD}{\pi d^3}$$

in which

P=Load in pounds

D=Mean diameter of the coil in inches (outside diameter minus the wire diameter)

d=Diameter of the wire in inches

S=Torsional stress in lb. per sq. in.

For the filament 60' having a diameter, d, of 0.078 in. and a mean diameter, D, (0.490 in–0.078 in) of 0.412 in. The torsional stress, S, assuming, for simplicity, a load of 10 pounds is $$S = \frac{2.55 \times 10 \times 0.412}{(0.078)^3} = 22{,}141.20 \text{ psi.}$$

By comparison, a wire which becomes trapezoidal in section upon coiling, e.g., a square wire or a wire that was previously trapezoidal in shape, has a torsional stress given by the formula $$S = \frac{2.4\,PD}{h^3}$$

in which

P=Load in pounds

D=Mean diameter (outside diameter - height or side of square wire before coiling)

h=height or side of square wire before coiling

S=Torsional stress in lbs. per sq. in.

For the trapezoidal filament 60 having a height, h, of 0.060 in., and a mean diameter, D, of (0.490 –0.060 ) of 0.430 in., the torsional stress, S, assuming, again, a load of 10 pounds is $$S = \frac{2.4 \times 10 \times 0.430}{(0.060)^3} = 47{,}777.78 \text{ psi.}$$

Thus a trapezoidal cross-section filament having about the same cross-sectional area as a circular cross-section filament has a torsional stress more than twice that of the circular cross-section filament.

Tests have shown that whereas the conventional circular cross-section filament 60' can survive 300 temperature cycles to 2000° C. at an on-off rate of 2 cycles per hour, the improved trapezoidal cathode filament 60 can withstand 300 temperature cycles to 2150° C. at the same repetition rate without failure. Additionally, the novel filament 60 can withstand 2500 hours at a constant temperature of 2150° C. without sagging while the conventional filament is limited to 2000° C. operating temperature.

Figure 5:
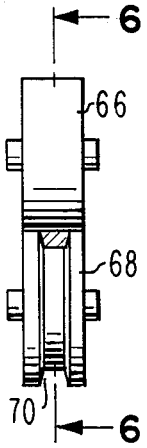
FIG. 5 is a plan view showing means for forming a quadrilateral cross-section filament of the cathode assembly of the present invention.
Figure 6:
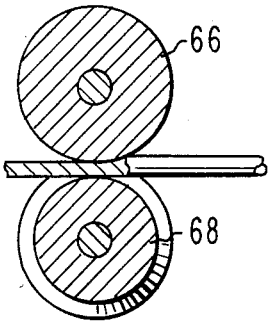
FIG. 6 is a sectional view taken along line 6—6 of FIG. 5.

The novel filament 60 is formed, as shown in FIGS. 5 and 6 by hot rolling a 2.29 mm diameter non-sag doped tungsten wire between a pair of rollers 66 and 68 to form a trapezoidal shaped wire. One of the rollers, for example, roller 68, has a race 70 formed therein which conforms to the desired final trapezoidal cross-section of the filament wire. After hot rolling, the wire is helically wound to form the filament 60.

What is claimed is:

1. In a magnetron having an evacuated envelope including therein a high temperature cathode assembly and an anode electorde surrounding said cathode assembly, wherein the improvement comprises said high temperature cathode assembly being formed of a helically wound filament having a quadrilateral cross-section, wherein one of said surfaces of said wound filament is wider than the others, the wider surface facing said anode electrode, the wider surface of said wound filament being held in tension and the oppositely disposed surface being placed in compression, said quadrilateral cross-section thereby increasing the strength and sag resistance of said wound filament.

2. The magnetron as in claim 1, wherein said filament forms a low angle helyx, thereby effectively approximating a cylindrical surface.

3. In a large power magnetron having an evacuated envelope including therein a high temperature cathode assembly and an anode electrode surrounding said cathode assembly, wherein the improvement comprises:

said high temperature cahtode assembly being formed of a low angle helically wound filament having a trapezoidal cross-section, wherein the wider surface of the trapezoidal shaped wound filament faces said anode electorde, the wider surface of said wound filament being held in tension and the oppositely disposed surface being placed in compression, said trapezoidal cross-section thereby increasing the strength and sag resistance of said wound filament.

4. In a large power magnetron having an evacuated envelope including therein a directly heated, high temperature cathode assembly, and an anode electrode surrounding said cathode assembly, wherein the improvement comprises:

said cathode assembly being formed of a low angle helically wound filament having a trapezoidal cross-section, said wound filament having an inside surface and an outside surface wherein said outside surface of said wound filament is wider than said inside surface, said outside surface facing said anode electrode, said outside surface being held in tension and said inside surface being placed in compression, the spacing between adjacent turns of said wound filament at the surface adjacent said anode electrode being less than the width of said outside surface, whereby said outside surface of said wound filament approximates a cylindrical surface, said trapezoidal cross-section thereby increasing the strength and sag resistance of said wound filament.

5. The magnetron as in claim 4, wherein said outside surface of said trapezoidal cross-section filament has a slightly concave shape due to the tension exerted thereon by helically winding said filament.

* * * * *